United States Patent [19]

Bodine

[11] 4,436,452

[45] Mar. 13, 1984

[54] SONIC PILE DRIVER SYSTEM EMPLOYING RESONANT DRIVE MEMBER AND PHASED COUPLING

[76] Inventor: Albert G. Bodine, 7877 Woodley Ave., Van Nuys, Calif. 91406

[21] Appl. No.: 397,563

[22] Filed: Jul. 12, 1982

[51] Int. Cl.[3] ..... E02D 7/18

[52] U.S. Cl. ..... 405/232; 173/49; 299/14; 405/228

[58] Field of Search ..... 405/232, 231, 228, 182; 299/14, 37; 173/49

[56] References Cited

U.S. PATENT DOCUMENTS

| | | | |
|---|---|---|---|
| 3,336,082 | 8/1967 | Bodine | 299/37 X |
| 3,367,716 | 2/1968 | Bodine | 299/14 |
| 3,499,293 | 3/1970 | Kato | 173/49 X |
| 3,527,501 | 9/1970 | Shatto | 299/37 |
| 3,633,683 | 1/1972 | Shatto | 405/182 X |
| 3,783,954 | 1/1974 | Bodine | 173/49 |
| 3,808,820 | 5/1974 | Bodine | 173/49 X |
| 3,920,083 | 11/1975 | Makita | 173/49 |
| 4,257,648 | 3/1981 | Bodine | 173/49 X |

*Primary Examiner*—Dennis L. Taylor

*Attorney, Agent, or Firm*—Edward A. Sokolski

[57] ABSTRACT

The vibrational output of a sonic oscillator is coupled to a compliant member which may comprise a steel stem member. The frequency of the oscillator is adjusted so as to effect resonant standing wave vibration of the compliant member. The resonant vibratory energy is coupled from the compliant member to the pile or other object to be driven by means of a coupler clamp which provides limited bidirectional freedom of motion along the axis of the pile. The coupler clamp further has a guide member which may comprise a partial skirt which controls the angular orientation between the pile and the compliant resonator member. This keeps the sonic energy concentrated along the axis of the pile and prevents significant lateral vibrational modes in the pile. The oscillator resonator member and pile are suspended from an appropriate structure, such as a boom, such that the downward bias weight at the coupler clamp can be controlled. In view of the limited freedom of motion provided in the coupler clamp, i.e., between the resonator member and the pile, and by means of the above-mentioned bias control, the portion of the vibratory energy cycle which is coupled to the pile can be controlled as desired to effect optimum driving of the pile.

15 Claims, 7 Drawing Figures

SONIC PILE DRIVER SYSTEM EMPLOYING RESONANT DRIVE MEMBER AND PHASED COUPLING

This invention relates to apparatus and a method for sonically driving piles or the like into earthen material, and more particularly to such an apparatus and method employing a resonantly driven drive member, the energy output of which is coupled to the pile only during a preselected portion of the vibratory cycle.

Prior art systems have been developed which employ resonant vibratory energy to drive column members, such as pilings, casings and the like, into earthen formations, such systems being described in my U.S. Pat. Nos. 3,783,954 and 3,808,820. In such systems, the piling member or the like being driven forms the major part of the resonant vibration system, the oscillator generally being tied to the pile either directly or through an intermediary member. Such resonantly vibrating systems provide fluidization of the earthen material which facilitates the penetration of the pile.

The system of the present invention provides an improvement over such prior art resonant pile driving systems in that it effects a more random and sharply excited motion of the soil particles so as to more easily permit penetration of the pile. By the same token, it has been found that with such highly randomized motion, the soil particles tend to more effectively compact against the pile when the energy is removed, thus providing a firmer installation of the pile.

This improved end result is achieved in the system and by the method of the present invention by employing a resonator member which is separate and apart from the pile being driven, this resonator member being energized by an orbiting mass oscillator which is coupled thereto and adjusted in frequency to effect the desired resonant operation. Only a selected portion of the vibrational cycle of the resonator member is coupled to the pile, such selective coupling being achieved by means of a coupler or clamp member which affords limited bidirectional freedom of motion between the resonator member and the pile along the axis of the pile, and with lateral vibrational coupling being limited by means of a guide member which may comprise a partial skirt, particularly when needed in demanding guidance situations. In a typical driving operation, the weight bias of the coupler is adjusted typically to provide energy coupling during something less than 180° of the vibration cycle.

The resonator member employed provides high "Q" for the storage of energy, particularly in view of the fact that energy is only being extracted during a portion of the vibration cycle so as to lessen the average time of loading of the resonant system. The coupler, in view of its bidirectional clearance, can be employed either to drive the pile downwardly or extracted upwardly with the same above-mentioned inherent advantages by adjusting the net bias direction of the resonator downwardly or upwardly. Further, by eliminating the pile or the like being driven as a major part of the resonant vibration system, the frequency of resonance employed need not depend on the length of the pile and can be designed for the desired optimum results by the choice of the parameters of the resonator member alone. Also, in view of the fact that tight gripping attachment between the pile and the resonator member is not required, the need for expensive clamp construction is obviated as well as the operational time involved in attaching and adjusting such clamps. In addition, these clamps ordinarily employ hydraulic pressure vise action along with hydraulic hoses, which are a hinderance in situations where the pile is rotatably driven. The coupler clamp of the present invention is amenable to a quick and easy attachment procedure which is of great advantage in field operation.

If so desired, the pile may be rotated simultaneously with the vibratory driving action, the type of coupling between the pile and the resonator member, as indicated above, greatly facilitating such rotatable drive.

Further pertinent prior art is shown in U.S. Pat. Nos. 3,663,683; 3,527,501; and 3,367,716, all of which show the use of sonic rectifiers in applications other than the driving of piles. The teachings of these prior art devices, while involving coupling of vibratory sonic energy during only a portion of the vibration cycle, do not include any suggestion of bidirectional coupling, angular or axial alignment to assure transfer of energy along a predetermined single axis, or means for adjusting the portion of the vibration cycle during which the coupling of energy to the pile is provided.

It is therefore an object of this invention to provide an improved method and apparatus for sonically driving piles into the earth.

It is another object of this invention to provide means for adjusting the portion of the vibration cycle during which energy is delivered to drive a pile into the earth.

It is a further object of this invention to provide an improved coupler clamp for attaching a sonic pile driver to a pile which is of more economic construction and easier to install than prior art clamps.

It is still a further object of this invention to provide an improved coupler for coupling sonic energy from a resonator member to a pile being driven into the earth wherein the coupling of energy is maintained along the longitudinal axis of the pile.

Other objects of the invention will become apparent as the description proceeds in connection with the accompanying drawings of which:

Figure 1:
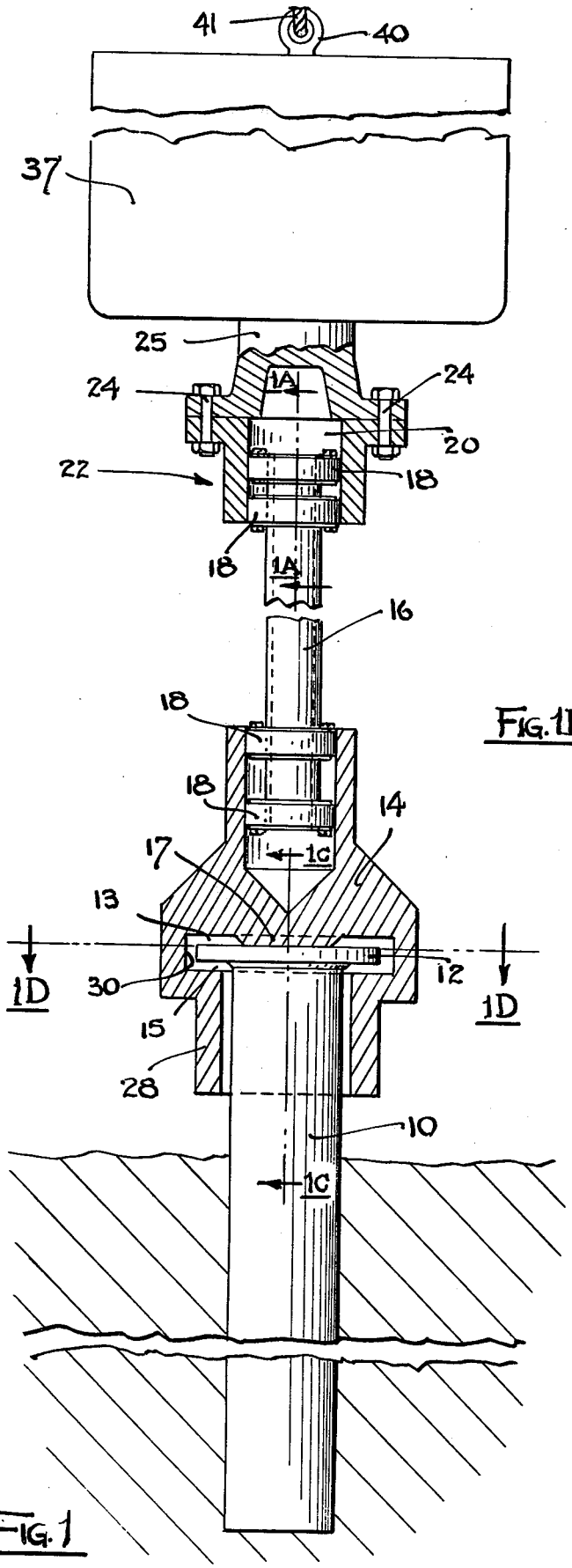
FIG. 1 is an elevational view in cross section illustrating a first embodiment of the invention.

It has been found most helpful in analyzing the operation of this invention to analogize the acoustically vibrating circuit utilized to an equivalent electrical circuit. This sort of approach to analysis is well known to those skilled in the art and is described, for example, in Chapter 2 of "Sonics" By Hueter and Bolt, published in 1955 by John Wiley and Sons. In making such an analogy, force F is equated with electrical voltage E, velocity of vibration u is equated with electrical current i, mechanical compliance $C_m$ is equated with electrical capacitance $C_e$, mass M is equated with electrical inductance L, mechanical resistance (friction) $R_m$ is equated with electrical resistance R and mechanical impedance $Z_m$ is equated with electrical impedance $Z_e$.

Thus, it can be shown that if a system is vibrated by means of an acoustical sinusoidal force $F_0 \sin \omega t$ ($\omega$ being equal to $2\pi$ times the frequency of vibration), $$Z_m = R_m + j[\omega M - (1/\omega C_m)] = F_0 \sin \omega t/u \quad (1)$$

Where $\omega M$ is equal to $1/\omega C_m$, a resonant condition exists, and the effective mechanical impedance $Z_m$ is equal to the mechanical resistance $R_m$, the reactive impedance components $\omega M$ and $1/\omega C_m$ cancelling each other out. Under such a resonant condition, velocity of vibration u is at a maximum, power factor is unity, and energy is more efficiently delivered to a load to which the resonant system may be coupled. It can also be shown that the resonant vibration frequency, f, of the system ($\omega$ being equal to $2\pi f$) is as follows:

$$f = \frac{1}{2\pi\sqrt{MC_m}} \quad (2)$$

It is important to note the significance of the attainment of high acoustical Q in the resonant system being driven, to increase the efficiency of the vibration thereof and to provide a maximum amount of power. As for an equivalent electrical circuit, the Q of an acoustically vibrating circuit is defined as the sharpness of resonance thereof and is indicative of the ratio of the energy stored in each vibration cycle to the energy used in each such cycle. Q is mathematically equated to the ratio between $\omega M$ and $R_m$. Thus, the effective Q of the vibrating circuit can be maximized to make for highly efficient high-amplitude vibration by minimizing the effect of friction damping in the circuit and/or maximizing the effect of mass in such circuit. In the present invention, Q is further enhanced by lowering the average damping load on the resonant system by coupling energy to the load only during a portion of the total vibration cycle.

It is also to be noted that orbiting mass oscillators are utilized in the implementation of the invention that automatically adjust their output frequency and phase to maintain resonance with changes in the characteristics of the load. Thus, in the face of changes in the effective mass and compliance presented by the load with changes in the conditions of the work material as it is sonically excited, the system automatically is maintained in optimum resonant operation by virtue of the "lock-in" characteristic of Applicant's unique orbiting mass oscillators. Furthermore, in this connection, the orbiting mass oscillator automatically changes not only its frequency but its phase angle and therefore its power factor with changes in the resistive impedance load, to assure optimum efficiency of operation at all times. The vibrational output from such orbiting mass oscillators also tends to be constrained by the resonator to be generated along a controlled predetermined coherent path to provide maximum output along a desired axis.

Figure 1A:
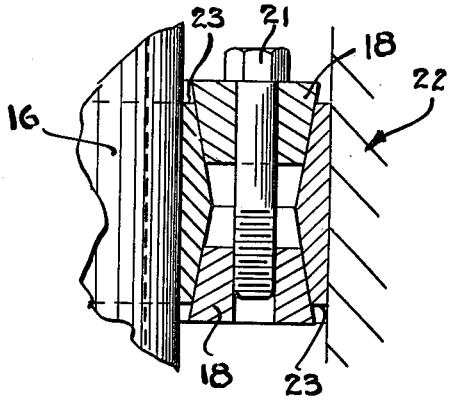
FIG. 1A is a cross-sectional view illustrating the clamp employed in the first embodiment for clamping the resonator member to the oscillator casing and the coupler.
Figure 1B:
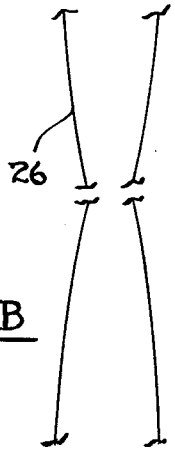
FIG. 1B are waveforms illustrating the wave pattern of the standing waves in the resonator member.
Figure 1C:
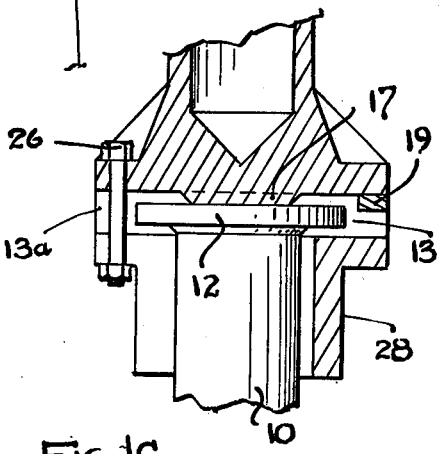
FIG. 1C is a view taken along the plane indicated by 1C—1C in FIG. 1.
Figure 1D:
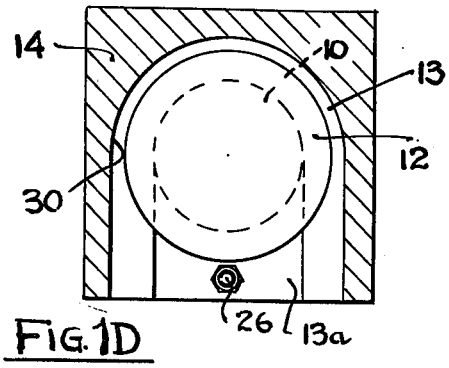
FIG. 1D is a view taken along the plane indicated by 1D—1D in FIG. 1C.

Referring now to FIGS. 1–1D, a first embodiment of the invention is illustrated. Sonic oscillator assembly 37, which may be of the type described in my U.S. Pat. No. 3,684,037, is suspended by means of support hook 40 and cable 41 from a suitable crane boom structure (not shown) of the type described in my aforementioned U.S. Pat. No. 3,684,037. Sonic oscillator assembly 37, which embodies an oscillator of the orbiting mass type, is suitably driven by an internal combustion engine, as shown in the aforementioned U.S. Pat. No. 3,684,037, at a suitable frequency, such as to engender longitudinal resonant standing wave vibration of the resonator member 16, which may comprise a steel tubular stem. The longitudinal standing wave vibration of stem 16 is indicated in FIG. 1B by graph lines 26 with the vibrational node of such standing wave vibration typically being somewhat above the center of the stem, and antinodes being towards the opposite ends of the stem.

The output from oscillator assembly 37 is tightly coupled to the top end of the stem 16 by means of mandrel 25 which is fixedly joined to the oscillator mandrel adapter 22 which is bolted to mandrel 25 by means of bolts 24. Mandrel adapter 22 has an internal cylindrical socket 20 which is fitted with a pair of standard full-circle annular internally and externally expanding bolted annular collets 18 which can be best seen in FIG. 1A, these collects being used to tightly grip the top end of stem 16 to the mandrel adapter 22. Collets 18 are drawn against wedge contact members 23 by means of bolts 21. Stem 16 typically comprises a 25-foot long, high quality steel tube having a 5" outside diameter and a $\frac{5}{8}$" wall thickness. The lower end of stem 16 is coupled to the upper socket wall of coupler clamp 14 in similar fashion to the above described upper end by a set of double expanding full-circle collets 18.

Coupler 14 is typically fairly massive (of the order of 500 pounds), but typically less massive than the total combined mass of the oscillator in assembly 37, mandrel 25 and mandrel adapter 32, such that the node of standing wave 26 very often lies above the center of stem 16. Typically, the mass of the oscillator mechanism, mandrel and mandrel adapter combined is about 700 pounds as compared with 500 pounds as already noted for coupler 14. Coupler 14 has a lateral cavity 13 formed therein which has an opening **13*a* at one end so as to permit the insertion of flange 12 therein, flange 12 being welded to the top end of pile 10. Thus, the flange is loosely fitted in cavity 13 and retained within the cavity by means of bolt 26 which is installed at the open end of the cavity as shown in FIG. 1C. Coupler 14 has a central engagement pad 17 which abuts against a top surface of cylindrical flange 12 when the coupler is in the downwardly biased and phased condition, as shown in FIG. 1. The clearance looseness space between flange 12 and the top and bottom opposing surfaces of cavity 13 should be at least one-eighth of the normal stroke distance of coupler 14 when it is operated in response to resonant stem 16** in a freely hanging condition without the pile attached thereto.

In operation this clearance looseness is mainly below the bottom edge of flange 12 as shown during typical driving when cable 41 is released sufficiently to bias much of the weight of coupler 14 down against pile 10.

Half skirt 28 subtends from the bottom of the coupler to aid in the control of the angular alignment of the pile 10 so as to minimize lateral vibration of the pile. The half skirt also limits the extent of slip-on distance for the pile within cavity 13 so as to maintain concentricity of the axes of stem 16 and pile 10. Thus, the clearance provided between flange 12 and the side walls 30 of the cavity, as well as the positioning of bolt 26 relative to the flange, combined with the restraining effect of the skirt against the pile, permits both the lateral and angular alignment of the center of the vibratory force vector applied to pile 10 through the coupler from stem 16. The axis of stem 16 stays on top of the axis of pile 10 without eccentric or lateral displacement, and furthermore the two axes do not assume an angular relationship. Such combined alignment prevents misdirected drive forces on the pile which induce unwanted lateral vibration thereof. Skirt 28 may be eliminated in certain operational conditions such as where such angular alignment can be controlled by maintaining sufficient tension in cable 41, and the lateral concentric alignment determined otherwise as for example by accurately controlling the positioning of flange 12 within cavity 13 by limiting its extent of travel, as by a stop protrusion 19 at the end of cavity 13 directly opposite bolt 26.

Figure 2:
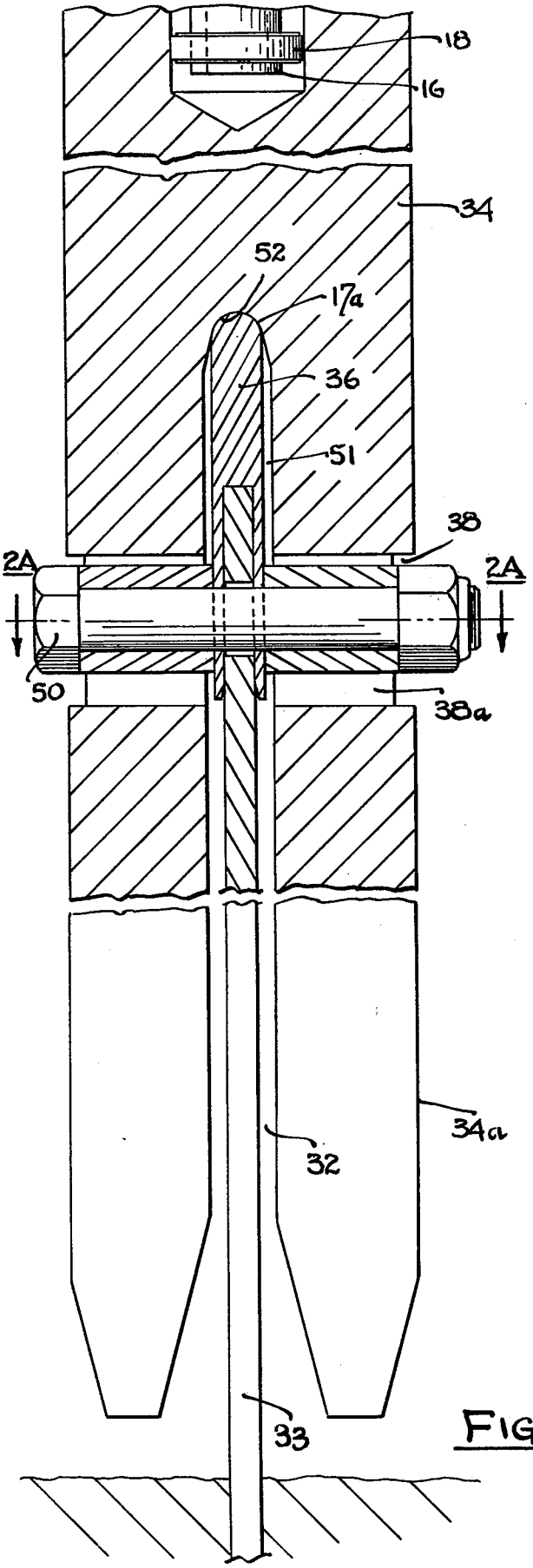
FIG. 2 is a cross-sectional view of a second embodiment of the invention suitable for driving sheet piles.
Figure 2A:
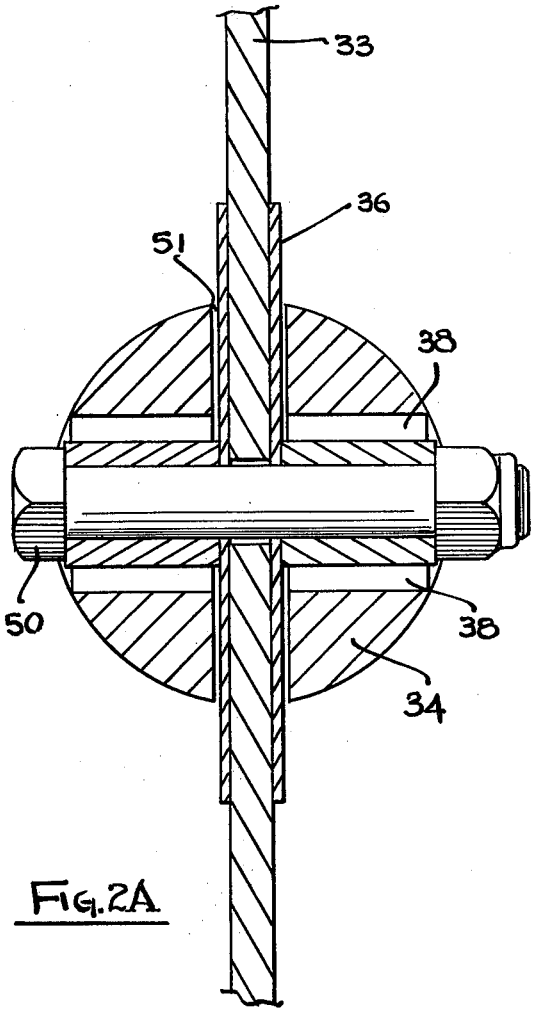
FIG. 2A is a view taken along the plane indicated by 2A—2A in FIG. 2.

Referring now to FIGS. 2 and 2A, a second embodiment of the invention is illustrated, this embodiment being suitable for driving sheet pilings 33. In this embodiment, the coupler 34 is attached to resonant stem 16 by means of a collet device 18 in the same manner as for the previous embodiment. Coupler member 34 in this instance comprises a forked body extension **34*a* which has an elongated slot 32 formed therein in which the sheet pile is confined for concentricity and angular alignment. An anvil insert 36 is slipped on and clamped to the top end of the sheet by means of bolt 50, this bolt 50 being loosely retained in the clearance opening 38 surrounding said bolt. As here shown, the top end 17*a* of the anvil insert is cyclically abutted against the top wall 52 of cavity 51 which is formed in coupler body 34. This downward bias is assured by releasing cable 41 sufficiently to bear mass 34 against pile 33. This is, of course, the same action during driving operation for the sheet pile as is shown for the cylindrical pile in FIG. 1, the member 34 being biased to accomplish the downdrive phase. In such position, most of gap 38*a* appears at the lower side of the bolt. In operation, gap 38*a* generally does not close and cycle the pile upward, unless the pile is being extracted by pulling with cable 41**. A particular advantage of the employment of the present invention in driving sheet piles is that in view of the predominant elimination of the upward excursions of the vibratory cycle, the pile is not driven vibratorily in the opposite directions of a full cycle, which two-directional motion tends to cause galling and friction welding in a standard tongue-and-groove engagement between adjoining pile sheets.

While the invention has been described and illustrated in detail, it is clearly to be understood that this is intended by way of illustration and example only and is not to be taken by way of limitation, the spirit and scope of the invention being limited only by the terms of the following claims.

I claim:

1. A sonic system for driving an elongated member into earthen material comprising means for generating sonic energy, an elongated compliant resonator member, means for coupling sonic energy from said generating means to said compliant resonator member, the frequency of said sonic energy being such as to cause resonant longitudinal standing wave vibration of said resonator member, coupler member means for coupling sonic energy from the resonator member to the elongated member and, means for adjusting the coupling of sonic energy to the elongated member to a preselected fractional portion of the total vibrational cycle of said resonant member, said elongated member being driven non-resonantly along the longitudinal axis thereof during said predetermined fractional portion of the vibrational cycle.

2. The system of claim 1 and further including means for substantially confining the energy to a direction along the longitudinal axis of said elongated member.

3. The system of claim 2 wherein the means for confining the energy along the longitudinal axis of the elongated member comprises a skirt subtending from the coupler member along and in proximity to said elongated member.

4. The system of claim 1 wherein the means for adjusting the coupling of energy to the elongated member comprises means for adjusting the downward bias on said coupler member means.

5. The sonic system of claim 1 wherein the means for generating sonic energy comprises an orbiting mass oscillator coupled to said compliant resonator member.

6. The sonic system of claim 1 wherein the compliant resonator member comprises an elongated steel tubular stem.

7. The sonic system of claim 1 wherein the elongated member comprises a pile having a flange on one end thereof, said coupler member means comprising a coupler having a lateral cavity formed therein with an opening formed at one end thereof to permit the insertion of the flange in said cavity, said flange being loosely fitted in said cavity.

8. The sonic system of claim 5 wherein the coupler member means has a substantial mass, the combined mass of said orbiting mass oscillator, the compliant resonator member, and said means for coupling sonic energy therebetween being substantially greater than that of said coupler member means such that the node of the standing wave vibration pattern formed therealong appears on a portion of the resonator member located away from the center thereof towards the oscillator.

9. A system for sonically driving an elongated pile into the ground comprising oscillator means for generating sonic energy, said oscillator means having mass inertia, an elongated elastic compliant member connected at one end thereof to said oscillator means, and coupling means having mass inertia for coupling the other end of said compliant member to said pile in a selected direction and for a selected phase of said sonic energy, there being loose coupling between the coupler means and said pile to provide clearance therebetween, the frequency of said oscillator means being adjusted to effect longitudinal resonant standing wave vibration of said compliant member between the mass inertia of the oscillator means and the coupling means.

10. The system of claim 9 and additionally including bias force control means for controlling the bias force between the coupling means and the pile thereby to determine the selected phase of the sonic energy coupled to the pile.

11. The system of claim 10 wherein the coupling between the coupling means and the pile permits bidirectional motion therebetween so as to enable either driving of the pile into the ground or extraction of the pile from the ground.

12. A method for driving an elongated pile into the earth comprising the steps of placing one end of the pile into engagement with the earth, placing elastic resonant means directly opposite the other end of the pile, coupling sonic energy to said elastic resonant means at a frequency such as to cause resonant standing wave vibration thereof, and coupling the elastic resonant means to the other end of the pile only during a selected phase portion of each vibratory cycle of the sonic energy to drive the pile unidirectionally into the earth.

13. The method of claim 12 and additionally including the step of rotating the pile simultaneously with the driving thereof into the earth.

14. The method of claim 12 and additionally including the step of adjusting the force bias placed on the other end of the pile in coupling the elastic resonant means thereto to effect the selection of said phase portion of each vibratory cycle during which the sonic energy is coupled to the pile.

15. The method of claim 12 and additionally including the step of maintaining the energy coupled to the pile in a direction substantially along the longitudinal axis of the pile.

* * * * *